US006250026B1

(12) United States Patent
Thompson, Jr.

(10) Patent No.: US 6,250,026 B1
(45) **Date of Patent: *Jun. 26, 2001**

(54) MULTI-SHEET GLAZING UNIT HAVING A SINGLE SPACER FRAME AND METHOD OF MAKING SAME

(75) Inventor: Albert E. Thompson, Jr., New Kensington, PA (US)

(73) Assignee: PPG Industries Ohio, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/016,536

(22) Filed: Jan. 30, 1998

(51) Int. Cl.[7] ..... E06B 7/12
(52) U.S. Cl. ..... 52/172; 52/204.591; 52/204.513
(58) Field of Search ..... 52/172, 204.591, 52/204.593, 204.595, 786.13, 800.14

(56) References Cited

U.S. PATENT DOCUMENTS

| | | | |
|---|---|---|---|
| 4,170,460 | 10/1979 | Donley . | |
| 4,239,816 | 12/1980 | Breininger et al. . | |
| 4,462,884 | 7/1984 | Gillery et al. . | |
| 4,610,711 | 9/1986 | Matesa et al. . | |
| 4,692,389 | 9/1987 | Gillery et al. . | |
| 4,719,127 | 1/1988 | Greenberg . | |
| 4,792,536 | 12/1988 | Pecoraro et al. . | |
| 4,806,220 | 2/1989 | Finley . | |
| 4,853,256 | 8/1989 | Obringer et al. . | |
| 4,853,257 | 8/1989 | Henery . | |
| 4,873,206 | 10/1989 | Jones . | |
| 4,898,789 | 2/1990 | Finley . | |
| 5,030,593 | 7/1991 | Heithoff . | |
| 5,177,916 | 1/1993 | Misera et al. . | |
| 5,240,886 | 8/1993 | Gulotta et al. . | |
| 5,313,761 | 5/1994 | Leopold et al. . | |
| 5,377,473 | 1/1995 | Narayan et al. . | |
| 5,531,047 | 7/1996 | Leopold . | |
| 5,553,440 | 9/1996 | Bulger et al. . | |
| 5,617,699 * | 4/1997 | Thompson | 52/786.13 |
| 5,644,894 | 7/1997 | Hudson . | |
| 5,655,282 | 8/1997 | Hodek et al. . | |

FOREIGN PATENT DOCUMENTS

| | | |
|---|---|---|
| 1165627 | 4/1984 | (CA) . |
| 1908567 | 9/1969 | (DE) . |
| 4226883 | 3/1993 | (DE) . |
| 0 223 511 | 5/1987 | (EP) . |
| 0 403 058 | 12/1990 | (EP) . |
| 0 475 213 | 3/1992 | (EP) . |
| 2350436 | 12/1977 | (FR) . |
| 2492880 | 4/1982 | (FR) . |

* cited by examiner

*Primary Examiner*—Beth A. Stephan
(74) *Attorney, Agent, or Firm*—Donald C. Lepiane

(57) ABSTRACT

A multi-sheet glazing unit includes a spacer frame having a pair of legs joined to a base to provide a U-shaped cross-section. A sheet e.g. glass sheet is secured by a moisture-impervious adhesive to outer surface of each of the legs of the spacer frame. A plurality of sheet retaining members in a spaced relationship to one another are maintained on the legs of the spacer frame between the glass sheets and spaced from the base. The sheet retaining members each have a groove for receiving edge of a sheet e.g. glass sheet to secure the sheet between the outer sheets. The sheet retaining member includes a first part having a vertical stop and a non-vertical platform e.g. horizontal platform and an elongated securing member detachably secured on the horizontal platform spaced from the vertical stop to form the groove. A method for making the unit is also disclosed.

32 Claims, 3 Drawing Sheets

MULTI-SHEET GLAZING UNIT HAVING A SINGLE SPACER FRAME AND METHOD OF MAKING SAME

FIELD OF THE INVENTION

This invention relates to a multi-sheet glazing unit and, in particular, to a multi-sheet glazing unit having a pair of outer glass sheets separated by and secured to a spacer frame and one or more glass sheet(s) between and spaced from the outer sheets and one another by sheet retaining members, and to a method of making a multi-sheet glazing unit.

BACKGROUND OF THE INVENTION

European Patent Application Publication Number 0 475 213 A1 published Mar. 18, 1992 Bulletin 92/12 (hereinafter "EP Application") and U.S. Pat. No. 5,655,282 (hereinafter "U.S. Pat. No. '282") disclose a thermal insulating glazing unit having three or more sheets with a spacer frame between and adhered to adjacent glass sheets. Although the techniques for making insulating glazing units having three or more sheets disclosed in the EP Application and U.S. Pat. No. '282 are acceptable, it would be advantageous to provide a multi-sheet glazed unit that does not have a spacer frame between adjacent glass sheets thereby reducing the number of spacer frames required in the fabrication of such units.

U.S. Pat. No. 5,531,047 (hereinafter "U.S. Pat. No. '047") discloses multi-sheet glazing units having one or more inner glass sheets spaced from and between a pair of outer glass sheets. In general, the outer glass sheets are separated by and secured to a spacer frame having a U-shaped cross section. On the base of the spacer frame between the outer legs is a layer of a pliable material having one or more groove(s) for receiving edge portions of the inner glass sheet(s). The unit of U.S. Pat. No. '047 is fabricated by wrapping spacer stock around the inner sheet(s) while positioning the edge portions of the inner sheet(s) in the groove(s) of the pliable material to position the inner sheet(s) within the spacer frame. After the inner sheet(s) is(are) within the spacer frame, the outer sheets are secured to the outer surfaces of the spacer frame by a moisture-impervious sealant. Although the techniques disclosed in U.S. Pat. No. '047 are acceptable, there are limitations. For example, positioning the spacer stock around the inner sheet(s) may disturb the pliable material on the base of the spacer frame, making the unit unsightly. Further mounting the intermediate sheet(s) in the pliable material on the base of the spacer stock requires time and mounting precision.

U.S. Pat. No. 5,644,894 (hereinafter "U.S. Pat. No. '894") discloses multi-sheet glazing units having one or more inner glass sheet(s) mounted within a U-shaped spacer frame and outer sheets adhered to outer surfaces of the spacer frame by a moisture-impervious sealant. The intermediate sheet(s) is(are) held in position by spaced rows of raised portions formed in the base of the spacer frame. Although the glazing units disclosed in U.S. Pat. No. '894 are acceptable, there are limitations. More particularly, providing spaced rows of raised portions in the base of the spacer frame requires an extra step in the process of making the spacer frame.

U.S. Pat. No. 5,553,440 (hereinafter "U.S. Pat. No. '440") also discloses multi-sheet glazing units having three or more glass sheets. In general, the units include a pair of outer glass sheets separated by and adhered to outer opposed surfaces of a spacer frame having a U-shaped cross-section. A sheet retaining member mounted between the upright legs of the spacer frame has one or more groove(s) for receiving marginal and peripheral edge portions of one or more inner sheet(s). Although the glazing units taught in U.S. Pat. No. '440 are acceptable, there are limitations. More particularly, wrapping the spacer stock around the inner sheet(s) while positioning the edge of the inner sheet(s) in the groove(s) of the sheet retaining members requires assembly time and precision.

United States Statutory Invention Regulation No. H975 (hereinafter "Publication H975"), published Nov. 5, 1991, discloses a multi-sheet unit having a pair of outer sheets spaced from one another by and secured to a spacer frame. An example of Publication H975 discloses the construction of the unit by mounting the edge supports on the edge portions of an inner sheet and setting the inner sheet having the edge supports within the closed spacer frame. Thereafter, the edge supports are secured to the frame. As can be appreciated, mounting edge supports on the edges of an inner sheet and thereafter, securing the edge supports to the spacer frame is time consuming.

As can now be appreciated, it would be advantageous to provide multi-sheet glazing units, i.e., glazing units having three or more sheets, and methods of making same that do not have the limitations of presently available multi-sheet glazing units and methods of making same.

SUMMARY OF THE INVENTION

This invention relates to a sheet retaining member having a sheet engaging member having a vertical stop and a horizontal support and a securing or locking member securable on the horizontal support spaced from the vertical stop to form a groove for receiving edge portion of a sheet e.g. glass sheet.

This invention also relates to multi-sheet glazing units, i.e., a glazing unit having three or more sheets. The multi-sheet unit includes a spacer frame having opposed legs and a base connected to one another to have a generally U-shape. A sheet is mounted on outer surface of each of the legs of the spacer frame, e.g., by a moisture-impervious sealant. A support facility is mounted on the spacer frame spaced from the base and between the sheets. A sheet engaging member is mounted on the support facility between the sheets to provide a sheet retaining member, and the sheet retaining member has a groove facing the interior of the spacer frame. The groove is formed by a wall defined as a first wall lying in a plane intersecting the base of the spacer frame and a securing or locking member secured to the sheet engaging member. The securing member having a wall defined as a second wall lying in a plane intersecting the base of the spacer frame. The first and second walls are spaced from one another to provide the walls of the groove of the sheet engaging member. A third or inner sheet is mounted in the groove.

The invention further relates to a method of making a multi-sheet glazing unit. The method includes, among other steps, the following steps. A spacer and a plurality of sheet retaining members are provided. At least one of the sheet retaining members has a vertical portion and a non-vertical portion to provide an edge stop, and has a securing or locking member. The sheet retaining members are mounted on the spacer frame spaced from one another with the edge stop facing the interior of the spacer frame. Edge portions of the sheet are biased against the edge stop afterwhich the securing member is secured to the non-vertical portion. An outer sheet is secured on each side of opposed sides of the spacer frame to provide the multi-sheet unit having outer sheets and inner sheet(s) spaced from one another.

DESCRIPTION OF THE INVENTION

The various embodiments of the instant invention will be discussed in the construction of a thermally insulating multi-sheet glazing unit having a low thermal is conducting edge determined as disclosed in the EP Application and U.S. Pat. No. '282 which disclosures are hereby incorporated by reference. As will be appreciated, the instant invention is not limited to a multi-sheet glazing unit that is thermally insulating and/or has a low thermal conductivity edge, and the embodiments of the present invention may be used with a multi-sheet glazing unit regardless of its thermal insulating properties, if any. In the following discussion, unless otherwise indicated, like numerals refer to like elements.

Figure 1:
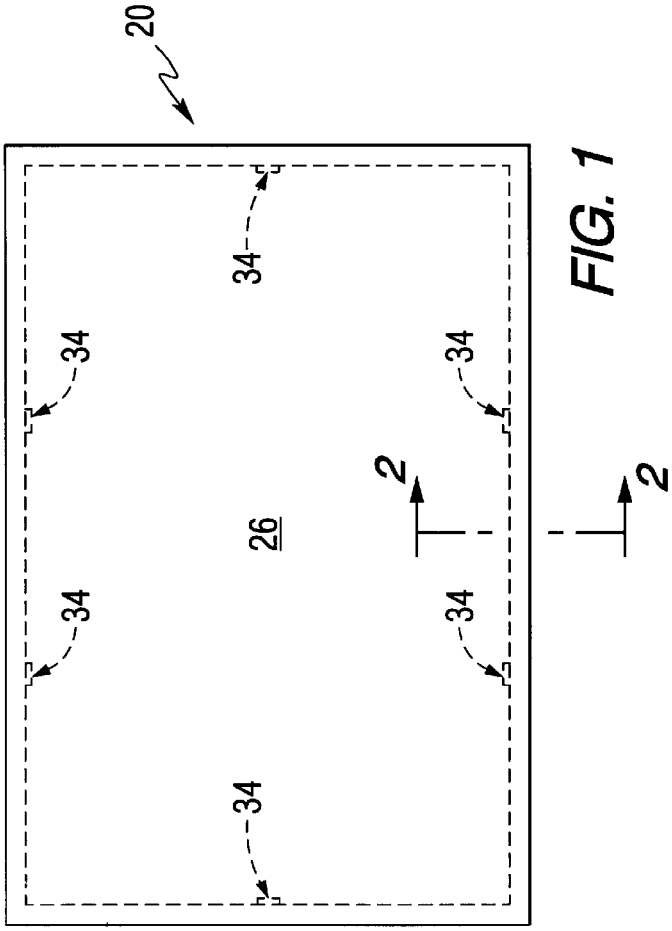
FIG. 1 is a front elevated view of a multi-sheet glazing unit incorporating features of the invention.
Figure 2:
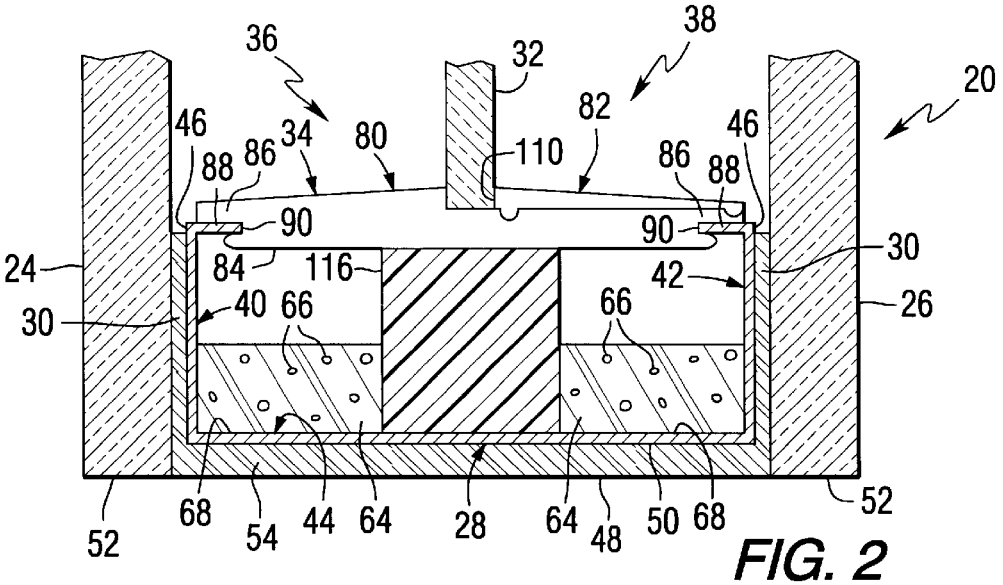
FIG. 2 is the view taken along lines 2—2 of FIG. 1.

FIG. 1 shows a multi-sheet glazing unit 20 incorporating features of the invention, and FIG. 2 shows a cross-sectional view of the multi-sheet unit 20. With specific reference to FIG. 2, the unit 20 has a pair of outer sheets 24 and 26 secured to a spacer frame 28 by a layer 30 of an adhesive, and an inner or intermediate sheet 32 held in position between the outer sheets 24 and 26 by sheet engaging members 34 (one only shown in FIG. 2) incorporating features of the invention to provide a compartment 36 between the sheets 24 and 32, and a compartment 38 between the sheets 26 and 32. Preferably, but not limiting to the invention, the compartments 36 and 38 are sealed against the egress and ingress of the atmosphere outside the compartments, e.g., gases, moisture and/or dust (hereinafter individually and collectively referred to as "environmental atmosphere") by the adhesive layers 30 discussed in more detail below.

In the following discussion, the sheets 24, 26 and 32 are glass sheets; however, as will become apparent, the sheets may be made of any material, e.g., glass, plastic, metal and/or wood, and the selection of the material of the sheets is not limiting to the invention. Further, the sheets may be made of the same material or the sheets may be made of different materials. Still further, one sheet may be a monolithic sheet, and the other sheet(s) may be laminated sheet(s), e.g., made of one or more monolithic sheets laminated together in any usual manner. One or more of the surfaces of one or more sheets may have an environmental coating to selectively pass predetermined wavelength ranges of light and energy, e.g., glass or plastic transparent sheets may have an opaque coating of the type used in making spandrels or the type of coatings disclosed in U.S. Pat. Nos. 4,170,460; 4,239,816; 4,462,884; 4,610,711; 4,692,389; 4,719,127; 4,806,220; 4,853,257, and 4,898,789, which disclosures are hereby incorporated by reference.

Further, in the practice of the invention, one or more of the glass sheets may be coated and/or uncoated colored sheets, e.g. but not limiting to the invention, colored sheets of the type disclosed in U.S. Pat. Nos. 4,873,206; 4,792,536; 5,030,593 and 5,240,886, which disclosures are hereby incorporated by reference. Still further, in the practice of the invention, the surfaces of the sheets may have a photocatalytic cleaning film or water reducing film, e.g., of the type disclosed in U.S. patent application Ser. No. 08/927,130 filed on Aug. 28, 1997, in the name of James P. Thiel for PHOTOELECTRICALLY-DESICCATING MULTIPLE-GLAZED WINDOW UNITS; U.S. patent application Ser. No. 08/899,257 filed on Jul. 23, 1997, in the names of Charles B. Greenberg et al., for PHOTOCATALYTICALLY-ACTIVATED SELF-CLEANING ARTICLE AND METHOD OF MAKING SAME, and U.S. patent application Ser. No. 60/040,566 filed on Mar. 14, 1997, in the names of Charles B. Greenberg et al., for PHOTOCATALYTICALLY-ACTIVATED SELF-CLEANING GLASS FLOAT RIBBON AND METHOD OF PRODUCING SAME, which disclosures are hereby incorporated by reference. The photocatalytic film disclosed in U.S. patent application Ser. Nos. 08/899,257 and 60/040,566 is preferably deposited on the outer surface of one or both sheets 24 and 26; however, the invention contemplates depositing the photocatalytic film on the inner surface of one or both sheets 24 and 26 and/or surfaces of the inner sheet 32. The water reducing film disclosed in U.S. patent application Ser. No. 08/927,130 is preferably deposited on one or more of the surfaces of the inner sheet(s) 32 or the inner surface of one or more of the outer sheets 24 and 26; however, the invention contemplates depositing the coating on the outer surface of one or both sheets 24 and 26.

The outer glass sheets 24 and 26 preferably have the same peripheral configuration and dimensions; however, as can be appreciated, one outer glass sheet may be larger than the other outer glass sheet. Further, one or more of the sheets 24, 26 and 32 may have different peripheral configurations than the remaining sheet(s).

With continued reference to FIG. 2, and not limiting to the invention, the spacer frame 28 has a generally U-shaped cross section defined by a pair of spaced outer legs 40 and 42 secured to a base 44 to have a generally "U" shape. The adhesive layer 30 is preferably a moisture-impervious material e.g. adhesive-sealant of the type used in the art of sealing compartments of insulating units. The layer 30 is provided on outer surface 46 of the legs 40 and 42 of the spacer frame 28 to secure the outer sheets 24 and 26 to the legs 40 and 42, respectively, of the spacer frame 28 to seal the compartments 36 and 38 against movement of environmental atmosphere into and out of the compartments.

It can now be appreciated that the material of the adhesive-sealant layers 30 is not limiting to the invention and is preferably a material that is gas and/or moisture impervious to prevent the ingress of environmental atmosphere into the compartment between the sheets. The material for layers 30 preferably has a moisture permeability of less than about 20 grams millimeter (hereinafter "gm mm")/square meter (hereinafter "$M^2$") day, and more preferably less than about 5 gm mm/$M^2$ day, determined using the procedure of ASTM F 372-73. Materials that may be used in the practice of the invention include, but are not limited to, butyls, silicones, polyurethane adhesives, and butyl hot melts of the type sold by H. B. Fuller, e.g., H. B. Fuller 5140. Units filled with an insulating gas, e.g., argon, preferably have the adhesive-sealant layers 30 of a moisture and/or gas impervious material to maintain the insulating gas in the compartments 36 and 38.

It is recommended that the adhesive-sealant layer 30 be thin and long to reduce the diffusion of the insulating gas out of or the environmental atmosphere moving into the compartments of the unit. More particularly, increasing the thickness of the layer 30, i.e., the distance between the glass sheet and the adjacent leg of the spacer frame, while keeping all other parameters constant increases the diffusion rate, and increasing the length of the layer 30, i.e., the distance between the top of the outer leg of the spacer frame and the base of the spacer frame as viewed in FIG. 2, while keeping all other parameters constant decreases the diffusion rate of gas through the adhesive-sealant layer 30. The invention may be practiced with the adhesive-sealant layers 30 each having a thickness of about 0.005 inch (0.013 centimeter, hereinafter "cm") to about 0.125 inch (0.32 cm), preferably about 0.010 inch (0.025 cm) to about 0.020 inch (0.050 cm) and more preferably, about 0.015 inch (0.38 cm), and the layers 30 each having a length of about 0.010 inch (0.025 cm) to about 0.50 inch (1.27 cm), preferably about 0.125 inch (0.32 cm) to about 0.50 inch (1.27 cm) and more preferably about 0.200 inch (0.50 cm).

With respect to the loss of the insulating gas, e.g., argon, from the compartments 36 and 38, the thickness and length of the layers 30 are chosen in combination with the gas permeability of the adhesive-sealant layers 30 so that the rate of loss of the insulating gas matches the desired unit performance lifetime. Preferably, the rate of loss of the insulating gas should be less than about 5% per year and, more preferably, it should be less than about 1% per year determined as described in the EP Application and U.S. Pat. No. '282.

A layer 48 of an adhesive, sealant or adhesive-sealant may be provided over outer surface 50 of the base 44 of the spacer frame 28. The layer 48 may be a material similar or dissimilar to the material of the layers 30. It is preferred that the material of the layer 48 be non-tacky so that the peripheral edges of the multi-sheet unit 20 do not stick to surfaces supporting the edge of the unit. Further, in the practice of the invention, multi-sheet units having the layer 48, preferably have the outer surface 50 of the base 44 of the spacer frame 28 recessed inwardly from the peripheral edges 52 of the outer sheets 24 and 26 as viewed in FIG. 2 to provide a channel 54 to receive the layer 48. The thickness of the layer 48 is not limiting to the invention, and the layer 48 may have a thickness of about 0.031 inch (0.08 cm) to about 0.50 inch (1.27 cm), preferably a thickness of about 0.150 inch (0.38 cm). The layer 48 preferably has similar moisture and gas permeability values as the layers 30. As can now be appreciated and with reference to FIG. 3, the instant invention contemplates multi-sheet units without the peripheral channel 54 and layer 48 as shown for multi-sheet unit 60 in FIG. 3. The outer surface 50 of the base 44 of the spacer frame 28 for the unit 60 shown in FIG. 3 may be in alignment with the peripheral edges 52 of the outer sheets 24 and 26 or may be recessed as shown in FIG. 2, or may extend beyond the peripheral edges 52 of the sheets 24 and 26 as shown in FIG. 4.

The spacer frame may be made of any material, e.g., wood, plastic, metal coated plastic, metal (e.g., stainless steel, galvanized steel or tin coated steel), or aluminum. Although the spacer frame may be made of any material, it is preferred that the spacer frame used in the practice of the instant invention have low thermal conductivity so that the spacer frame 28, the adhesive-sealant layers 30 and the layer 48, if present, collectively define an edge assembly that separates the outer sheets 24 and 26, and has a low thermal conductivity or high RES-value. Further, in the practice of the invention, it is preferred to use a spacer frame made of a material that is moisture and/or gas impervious e.g. but not limited to metal, e.g., stainless steel, halogenated polymeric material, and/or a gas-previous material covered with an impervious film, e.g., metal or polyvinylidene chloride film.

The EP Application and U.S. Pat. No. '282 discuss in detail the concept of edge assemblies having low thermal conductivity and determination of RES-value and reference may be made thereto for a detailed discussion.

Figure 9:
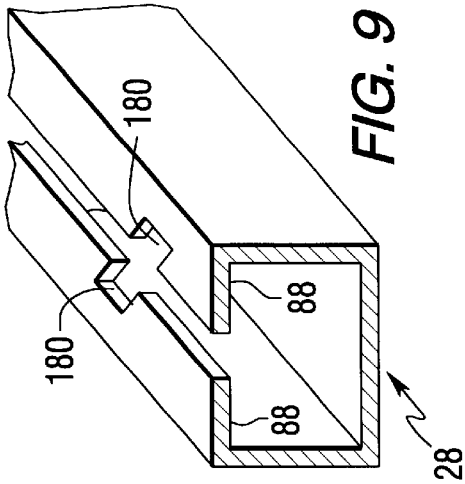
FIG. 9 is a partial isometric view of a spacer frame having cutouts for receiving the sheet retaining member incorporating feature of the invention.

Although the invention is not limited to the cross sectional configuration of the spacer frame design, it is preferred in the practice of the invention to use a spacer frame having a U-shaped cross section, e.g., of the type shown in FIGS. 2 and 3, to secure the sheet retaining member 34 of the instant invention in position in a manner to be discussed below. In the practice of the invention, the spacer frame may have a generally U-shape cross section as shown for spacer frame 28 of FIG. 9; a generally rectangular cross section as shown for spacer frame 62 of FIG. 4, or a W-shaped cross-section as shown in U.S. Pat. No. 5,377,473. Further, in the practice of the invention the spacer frame is a closed spacer frame made from a continuous piece of spacer stock as disclosed in U.S. Pat. No. 5,177,916 (hereinafter "U.S. Pat. No. '916"); however, as can be appreciated, the invention is not limited thereto and may be made from sections of spacer stock, e.g., of the type disclosed in the EP Application and U.S. Pat. No. '282 and joined together by corner keys or welding sections.

Referring back to FIG. 2, one or more bead(s) 64 of a moisture-pervious material having a desiccant 66 therein is provided on inner surface 68 of the base, i.e., the surface of the base between the outer legs of the spacer frame. The bead(s) 64 may be made of any moisture-pervious material. Although the invention is not limited thereto, moisture-pervious materials having a permeability greater than about 2 gm mm/$M^2$ day as determined by the procedure set out in ASTM F 372-73 are recommended in the practice of the invention. Such materials are disclosed in the U.S. Pat. Nos. 5,177,916; 5,531,047 and 5,655,282, which patents are hereby incorporated by reference.

As can be appreciated, having a water reducing film disclosed in U.S. patent application Ser. No. 08/927,130 on selected surfaces of the inner surfaces of outer sheets 24 and 26 and surfaces of inner sheet 32 may be used to reduce the amount of desiccant required in the bead 64 or eliminate the need for the desiccant and the bead.

As can now be appreciated, the bead 64 may be used in the hollow rectangular spacer 62 shown in FIG. 4 or loose desiccant 66 may be provided in the hollow rectangular spacer or the desiccant eliminated.

Figure 5:
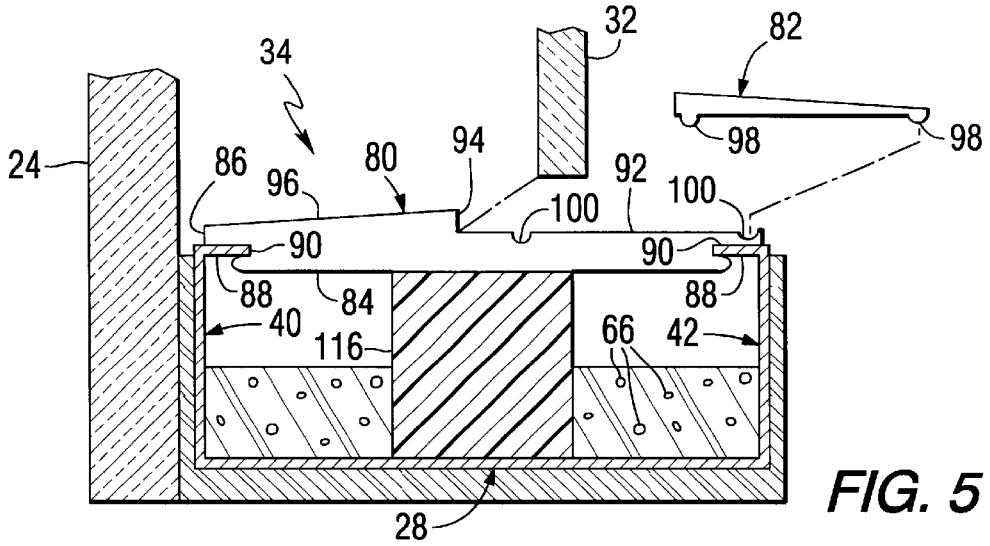
FIGS. 5 and 6 are views similar to the view of FIG. 2 showing selected steps practiced in the fabrication of a multi-sheet glazing unit incorporating features of the invention.
Figure 6:
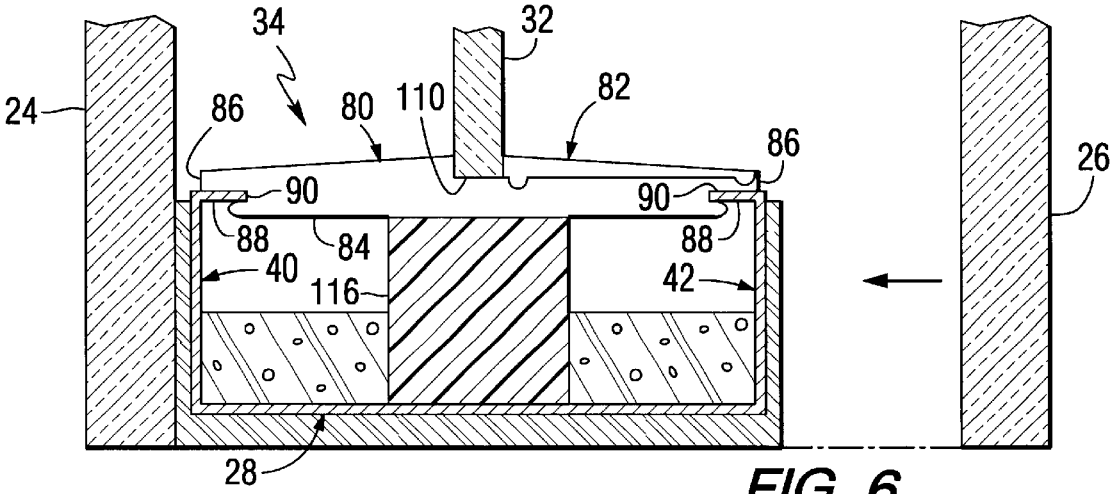

The discussion will now be directed to the sheet retaining member 34 of the instant invention. With reference to FIGS. 2, 5 and 6 and with specific reference to FIGS. 5 and 6, the sheet retaining member 34 has a sheet engaging member 80 and a securing or locking member 82. The sheet engaging member 80 has a support portion 84 which is captured between the legs 40 and 42 of the spacer frame 28 as shown in FIGS. 2, 5 and 6. Extensions 86 of the sheet engaging member 80 rest on upper portions of the legs 40 and 42 of the spacer frame 28. Although not limited to the invention, ends 88 of the outer legs 40 and 42 of the spacer frame 28 are bent toward one another and received in recess 90 provided on each side of the support portion 84. The support portion 84 is sized and shaped such that moving the sheet retaining member 34 between the legs 40 and 42 of the spacer frame, moves the legs 40 and 42 of the spacer frame 28 apart to receive the support portion 84. Continued downward motion of the sheet retaining member 34 as viewed in FIG. 5 seats the extensions of the support portion 84 on top of the legs 40 and 42 of the spacer frame as viewed in FIGS. 2, 5 and 6 and moves the ends 88 of the legs 40 and 42 into the recesses or grooves 90 of the support portion 84.

With continued reference to FIG. 5, the sheet engaging portion 80 of the sheet retaining member 34 has an upper flat surface 92 and vertical stop surface 94 and a sloped surface 96. The locking member 82 has a pair of protrusions 98 that are captured in holes 100 in the flat surface 92 of the sheet engaging member 80. When the locking member 82 is secured to the flat surface 94 by inserting the protrusions 98 into the holes 100 (see FIG. 6), the locking member 82 and the vertical stop surface 94 provide the sheet retaining member 34 with a groove 110 as shown in FIGS. 2 and 6 for having the edge of the intermediate sheet 32 to secure the intermediate sheet 32 in position between the outer sheets 24 and 26 as shown in FIGS. 2 and 6.

As can be appreciated, the locking member 82 may be secured to the flat surface 92 to provide the groove 110 in any usual manner. For example, the locking member may be secured to the flat surface by an adhesive, or application of heat to fuse the pieces together or may be detachably secured using hole and protrusion combinations. With reference to FIG. 3, there is shown sheet retaining member 111 having locking member 112 hinged at one end e.g. end 113 as shown in FIG. 3. The locking member 112 shown in phantom is the position prior to securing the inner sheet 32 in position.

As can be appreciated, the invention is not limited to the material of the sheet retaining member of the invention. For example, the sheet retaining member may be made of plastic, rubber, metal, wood, glass and/or reinforced plastic. In the practice of the invention it is preferred that the sheet retaining member be made of plastic because it is thermally non-conductive and economic to form. Further, as can be appreciated, the sheet retaining member may be a one piece formal member or a member made up of several parts e.g. sheet engaging member 80, support portion 84 and locking member 82. As can further be appreciated by those skilled in the art, the material of the sheet retaining member should be selected or prepared so that there is no outgassing of the material during use.

The sheet engaging member 80 of the sheet retaining member 34 may be mounted on the spacer frame in any usual manner. For example, as discussed above and shown in FIGS. 2, 5 and 6 the sheet engaging member and support portion 84 are together as one piece and the ends 88 of the legs 40 and 42 of the spacer frame 28 may be captured in the grooves 90 of the support portion 84. Sheet retaining member 114 incorporating features of the invention shown in FIG. 4 does not have the support portion 84 as does sheet retaining member 34. The sheet retaining member 114 may be mechanically or adhesively secured at 115 to the rectangular cross-sectional spacer frame 62.

Figure 3:
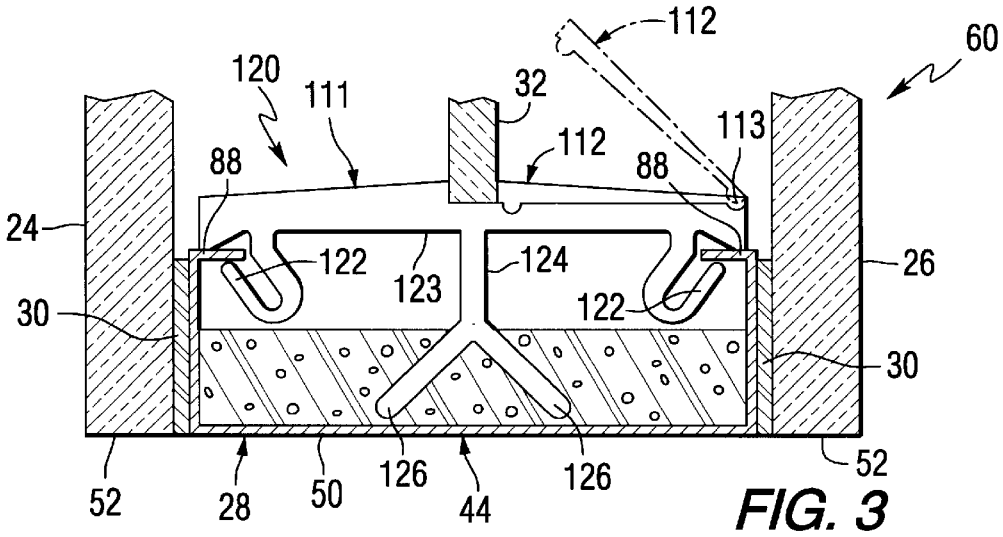
FIG. 3 is a view similar to the view in FIG. 2 illustrating another embodiment of the sheet retaining member of the instant invention.
Figure 4:
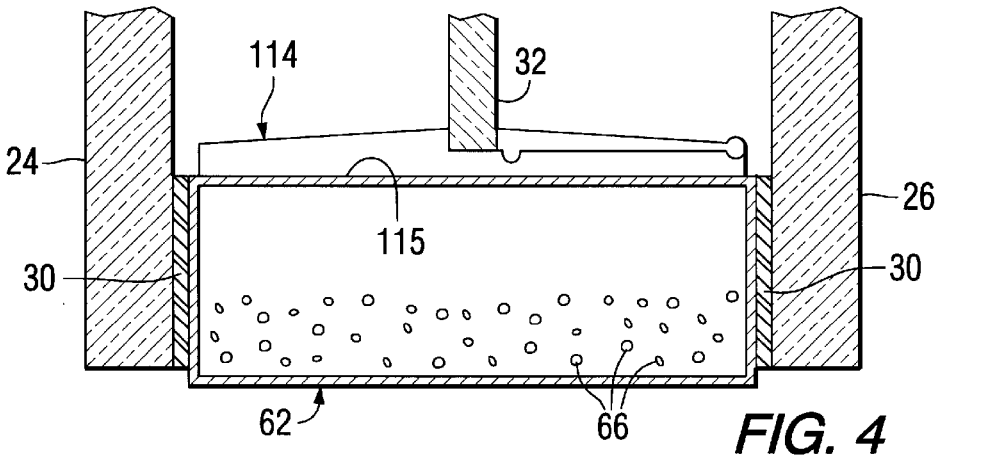
FIG. 4 is a view similar to the view of FIG. 2 illustrating still another embodiment of the sheet retaining member of the instant invention.

In the instance where the sheet retaining member of the instant invention is used with a U-shaped spacer frame, e.g., the spacer frame 28, and the inner sheet 32 has significant weight or more than one inner sheet is used, a support shim 116 may be used under the retaining member 34 as shown in FIGS. 2, 3 and 5 to prevent the edge retaining member from dropping between the legs of the spacer frame. The support shim 116 may be made of any structurally stable material and is preferably made of plastic. When the support shim 116 and the bead 64 having the desiccant 66 are used, the bead 64 may be provided on each side of the shim or the shim may be pushed into the moisture-pervious matrix of the bead if it is sufficiently soft at room temperature. One type of moisture pervious matrix that is soft at room temperature is PRC 525DM sold by Courtaulds Aerospace. As can be appreciated, the width of the shim is not limiting to the invention and may extend into contact with the legs 40 and 42 of the spacer frame 28.

In the practice of the invention, the sheet retaining member may extend along each elongated side of the spacer frame or along any selected elongated sides of the spacer frame. In the instance where a plurality of sheet retaining members are used along an elongated side of the spacer frame, it is suggested that a sheet retaining member be used at the midpoint of an elongated side of the spacer frame when the elongated side is less than about 2 feet (30 cm), at the quarter points when the elongated side is more than about 2 feet (30 cm) and less than about 4 feet (60 cm), and about every 12 inches (30 cm) when the elongated side is greater than about 4 feet (60 cm). A support shim 116 under the sheet retaining member 34 is also recommended to prevent the sheet retaining member from dropping between the legs of the spacer frame when the multi-sheet glazing unit incorporating features of the invention is in use.

As can be appreciated by those skilled in the art, increasing the wall thickness of the spacer frame provides additional structural stability to support the sheet retaining member. However, increasing the wall thickness of the spacer frame increases thermal conductivity of the spacer frame and increases the weight of the unit. Reducing the weight of the inner sheet by making it thinner and/or from a material lighter than glass e.g. plastic may be considered to eliminate the need of a shim.

With reference to FIG. 3, there is sheet retaining member 120 incorporating features of the invention. More particularly, the sheet retaining member 120 has a pair of flexible fingers 122 at each side of the support portion 123 as viewed in FIG. 3. As the sheet retaining member 120 is moved downward as viewed in FIG. 3 between the legs of the spacer frame, fingers 122 flex inwardly e.g. to a biased position by the contact action of the ends 88. As the support 80 is seated on the legs e.g. ends 88 of the spacer frame, the fingers 122 flex to the original position i.e. to an unbiased position to capture the ends 88 between the fingers 122 and the underside of the support portion 123 as shown in FIG. 3. Further, as shown in FIG. 3, shim 124 has an inverted Y shape with legs 126 resting on the base 44 of the spacer frame.

The height of the sheet retaining member extending above the top of the spacer frame, i.e., the top of the legs 40 and 42 as viewed in FIG. 2 is not limiting to the invention. However, as can be appreciated, the more the sheet retaining member extends above the top of the spacer legs; the more visible is the sheet retaining member. Further, the higher the base of the groove 110 above the legs of the spacer, the greater the distance between the edge of the inner sheet 32 and the base of the spacer frame or the bead(s) 64. As the distance increases, air circulation between compartments 36 and 38 increases, moving the insulating gas between the compartments and setting up thermal paths. SIR H975 has a discussion regarding the spaced distance and reference may be made thereto. Although not limiting to the invention, in the practice of the invention, it is preferred that there is no spaced distance between the edge of the intermediate sheet 32 and the base of the spaced frame or the bead 64 if present. However, the invention contemplates any distance therebetween, e.g. a distance of 0 to about ¼ inch (0.64 cm) and preferably about 1/32 inch (0.08 cm).

As can now be appreciated, the distance may be decreased by increasing the thickness of the bead, and/or increasing the thickness of support member.

Further, as can be appreciated, any space between the edge of the sheet 32 and base of the spacer frame or bead 64 can be eliminated by providing a sheet retaining member along the complete bottom and/or to elongated side of the unit thereby preventing any air circulation between the compartments.

The invention will be discussed to make a glazing unit similar to the unit 20 shown in FIGS. 1 and 2 having a closed spacer frame made from a continuous piece of spacer stock. Each of the outer sheets 24 and 26 are clear glass sheets having a length of about 42⅞ inches (108.9 centimeter, hereinafter "cm") and a width of about 19¾ inches (50.17 cm). The inner sheet 32 is a clear glass sheet having a length of about 42¼ inches (107.30 cm) and a width of about 19⅛ inches (48.57 cm). All the sheets have a thickness of 0.090 inch (0.229 centimeter).

The surface of the glass sheets 24 and 26 designated to be the inner surfaces have a coating of the type sold by is PPG Industries under its registered trademark Sungate® 100 coated glass. The designated outer surfaces have a photocatalytic cleaning film of the type disclosed in U.S. patent application Ser. Nos. 08/899,257 and/or 60/040,566. The surfaces of the inner sheet 32 have a water reducing film of the type disclosed in U.S. patent application Ser. No. 08/927,130.

Figure 7:
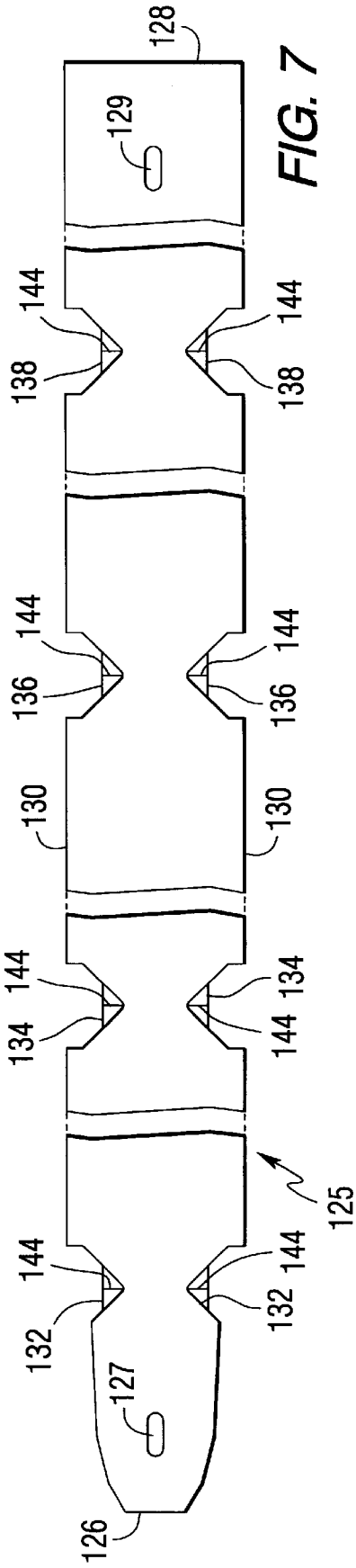
FIG. 7 is a plan view of a strip prior to shaping the strip into a spacer stock having the U-shaped cross sectional configuration shown in FIGS. 2, 3, 5, 6 and 8.

A spacer frame 28 having four continuous corners is made as follows. With reference to FIG. 7, a flat tin coated steel strip 125 having a length of about 126 inches (320 cm), a width of about 1.25 inches (3.18 cm) and thickness of about 0.010 inch (0.25 mm) is die cut. After die cutting, the strip 125 as shown in FIG. 7 has a tapered and wedged end 126 having a hole 127. Opposite end 128 of the strip 125 has a hole 129. Spaced at locations about 1.5 inches (3.8 cm), about 21⅛ inches (53.65 cm), about 63⅞ inches (162.24 cm), and about 83½ inches (212.09 cm) from the end 126, material is removed from opposite edge portions 130 of the substrate 125 to provide sets of paired notches 132, 134, 136 and 138 respectively. The notched areas form the bent portions 140 (shown only in FIG. 8), and the notches provide for the bent portions 140 to be a sufficient distance so as not to overlap and eliminate the extension 88 of the legs 40 and 42 for ease of bending the spacer stock to provide the closed spacer frame. Crease lines 144 are provided at the notches as shown in FIG. 7 for ease of bending the subsequently formed spacer stock to form a closed spacer frame having continuous corners as disclosed in U.S. Pat. Nos. '047 and '916 which disclosures are hereby incorporated by reference.

Each of the notches of the set of paired notches 134, 136 and 138 have a length of about 0.536 inch (1.36 cm) at the edge 130 of the substrate, a depth of about 0.170 inch (0.43 cm) as measured from the edge 130 of the substrate toward the center of the substrate. The notches 132 are similar in size as the notches 134, 136 and 138 but the left side of the notch as shown in FIG. 7 is further cut to insert the end 126 into the end 128 after the strip 125 is formed into the spacer stock having a U-shaped cross section. The distance between the points of pairs of notches depends on the width of the base of the spacer frame, i.e., the desired spacing between the outer sheets. The unit has the point of the crease lines spaced about 0.500 inch (1.27 cm) from the edge 130 of the substrate to provide the base with a width of about 0.50 inch (1.27 cm) and ends 88 having an extension of about 0.078 inch (0.18 cm).

The strip 125 is shaped to provide a spacer stock having a U-shaped cross section as shown in FIG. 2. Ends 130 of the substrate 125 are bent over to form the ends 88 to provide the spacer frame with structure stability, and to secure the sheet retaining member in position as disclosed above and further discussed below. The layers 30 and 48 of the adhesive-sealant are provided on the outer surfaces 46 of the legs 42 and 44 and outer surface 50 of the base 44 of the spacer frame 28.

A bead 64 of H. B. Fuller HL 5102X-125 butyl hot melt matrix having the desiccant 66 is flowed on the inner surface 68 of the base 44 in any usual manner. Thereafter the spacer stock is bent to form a closed spacer frame. A rivet or screw (not shown) may be used to secure the ends 126 and 128 together to provide the closed frame. The spacer frame having the adhesive-sealant layer 30 is adhered to the designated inner surface of one of the outer sheets, e.g., the sheet 24, as shown in FIG. 5.

Six sheet retaining members 34 of the instant invention made of plastic are provided. With reference to FIG. 5, the sheet retaining member 34 has the sheet engaging member 80 having a length (along the length of the spacer) of about 0.5 inch (1.27 cm) and a width of about 0.470 inch (1.9 cm) as measured between the ends of the extension 86. The support portion 84 has a width of about 0.348 inch (0.088 cm). The recesses 90 have a depth of 0.002 inch (0.005 cm). The extensions 86 have a height of about 0.022 inch (0.005 cm). The flat portion 92 has a length of about 0.263 inch (0.67 cm). Sloping side 96 has a length of about 0.208 inch (0.52 cm). The locking member 82, the protrusion 98 and the holes 100 are sized to lock the locking member 82 in position by inserting protrusions 98 into the holes 100 in the flat portion 92 and to give a balanced configuration. Support shims 116 made of plastic have a height of about 0.206 inch (0.52 cm), a length of about 0.5 inch (1.27 cm) and a depth of about 0.20 inch (0.51 cm) are positioned between the legs 40 and 42 of the spacer frame. The shim is set in position and the sheet retaining member is mounted to the spacer frame as previously discussed at the quarter points on the long side of the spacer frame and at the mid point for the short side of the spacer frame.

The intermediate sheet 32 is positioned on the flat portion 92 of the sheet engaging member against the vertical stop 94 as shown in FIGS. 5 and 6. Thereafter, the locking member 82 is snapped into position by inserting the extensions 98 into the holes 100 (the protrusions 98 and holes 100 clearly shown in FIG. 5). Thereafter, the designated inner surface of the sheet 26 is adhered to the leg 42 of the spacer frame 28 by the layer 30 of adhesive-sealant.

The outer glass sheets 24 and 26 are biased toward one another to flow the adhesive-sealant layer 30 to secure the outer glass sheets to the spacer frame. If the layer 48 of the adhesive-sealant is not provided on the outer surface of the spacer frame, the layer 48 of the adhesive-sealant is flowed into the channel 54 formed by the marginal edge portions of the sheets 24 and 26 and the base 44 of the spacer frame 28.

As can be appreciated, the bead 64 having the desiccant 66 may be extruded before, after, or during the extrusion of the layers 30. Further, the layer 48 may be applied during or after the strip is formed into spacer stock. Still further, as now can be appreciated, the invention is not limited to the sequence of steps to make the unit. For example, and not limiting to the invention, after the spacer frame having the bead 64 is provided, the sheet retaining members 34 are mounted on the closed frame. Thereafter the intermediate sheet 32 is secured in position, the layer 30 and sheets 24 and 26 are mounted on the legs 40 and 42 respectively of the spacer frame.

As can now be appreciated, the invention is not limited to the number of intermediate sheets 32 or the configuration of the sheet retaining member of the invention.

Figure 8:
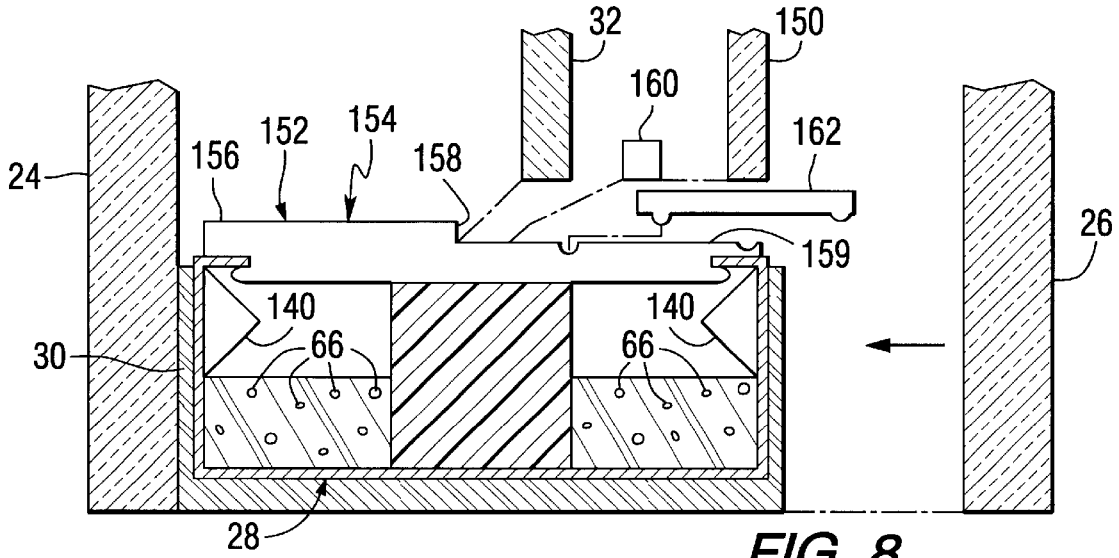
FIG. 8 is a view similar to the view of FIG. 5 showing construction of a multi sheet glazing unit of the instant invention having two inner sheets.

With reference to FIG. 8, there is shown the construction of a unit having two inner sheets 32 and 150. As shown in FIG. 8, the spacer frame 28 is mounted to marginal edges of the sheet 24 by the layer 30 of the adhesive-sealant. The sheet retaining member 152 is secured to the spacer frame in a similar manner as the sheet retaining member 34 was secured to the spacer frame. The sheet engaging member 154 has a flat surface 156 instead of the sloped surface 96 (compare FIG. 5 with FIG. 8). The inner sheet 32 is moved against vertical stop 158. A spacer or separator block 160 is mounted or secured e.g. by holes and protrusions or by an adhesive on flat surface 159 against the inner sheet 32. The second inner sheet 150 is moved against the spacer block 160 and elongated locking or securing member 162 is secured in position in a manner similar as the locking or securing member 82 was secured in position. Thereafter, the outer sheet 26 is mounted on the other side of the spacer frame and the outer sheets biased toward one another to provide a multi-sheet glazing unit having four sheets and three compartments.

Another embodiment of the invention for making a multi-sheet glazing unit having four sheets contemplates having a sheet retaining member having a horizontal platform e.g. a platform 159 on each side of a raised portion having a vertical surface e.g. similar to the vertical surface 158. A sheet e.g. sheet 32 is mounted on one of the horizontal platforms against one of the vertical surfaces and secured in a securing position by member as previously discussed. A sheet e.g. sheet 150 is mounted on the other one of the horizontal platforms against the other one of the vertical surfaces and secured in position by a securing member as previously discussed. Thereafter the outer sheets 24 and 26 are secured in position as previously discussed.

As can now be appreciated, the invention is not limited to the embodiments of the glazing units discussed above, and additional embodiments can be made within the scope of the invention. For example, and with reference to FIG. 9, the extensions 88 of the spacer frame have cutouts 180 to minimize any movement of the sheet retaining member along the elongated side of the spacer frame and to maintain the sheet retaining member over the shim 116 shown in FIG. 2.

The scope of the invention is only limited by the scope of the following claims.

What is claimed is:

1. A sheet retaining member comprising:

a sheet engaging member having a vertical stop having a surface in a plane defined as a first plane and a non-vertical support having a surface in a plane defined as a second plane, the first and second planes intersecting one another, and a securing member securable on the non-vertical support, a surface of the securing member lying in a plane defined as a third plane, the third plane spaced from and in facing relationship to the first plane wherein the surface lying in the first plane, the surface lying in the second plane and the surface lying in the third plane cooperating with one another to form a groove.

2. The sheet retaining member according to claim 1 wherein the sheet engaging member includes a support portion for securing the sheet engaging member on a spacer frame.

3. The sheet retaining member according to claim 2 wherein the support portion has a pair of opposed sides and a groove extending along at least a portion of each of the pair of opposed sides.

4. The sheet retaining member according to claim 2 wherein the support portion has a surface opposite to the surface of the non-vertical support and further including at least one protrusion extending from the surface of the support portion away from the surface of the non-vertical support.

5. The sheet retaining member according to claim 4 wherein the at least one protrusion is a plurality of spaced fingers, at least one of the fingers having a first finger member extending from the support portion away from the surface of the non-vertical support and a second finger member connected to the first finger member and extending toward the surface of the non-vertical support.

6. The sheet retaining member according to claim 1 wherein the securing member is pivotally mounted on the vertical support for movement toward and away from the vertical stop.

7. The sheet retaining member according to claim 1 wherein the non-vertical support has at least one hole or at least one protrusion and the securing member has at least one protrusion or at least one hole such that the at least one hole and the at least one protrusion cooperate with one another to secure the securing member on the non-vertical support.

8. A multi-sheet glazing unit comprising:

a spacer frame having at least a base and opposed legs, the base and opposed legs connected to one another to have a generally "U" shape, the opposed legs each having an outer surface;

a sheet on the outer surface of each of the opposed legs;

a sheet retaining member mounted on the spacer frame spaced from the base and between the sheets, the sheet retaining member having a sheet engaging member having a generally vertical wall defined as a first wall and a securing member secured on the sheet engaging member, the securing member having a wall defined as a second wall spaced from the first wall to provide a groove facing interior of the spacer frame, and a third sheet mounted within the groove of the sheet retaining member to secure the third sheet in position between the outer sheets.

9. The glazing unit according to claim 8 wherein the sheet retaining member has a support portion for securing the sheet engaging member to the spacer frame wherein the support member and sheet engaging member are formed as one piece.

10. The glazing unit according to claim 8 wherein the spacer frame has a generally "U" shaped cross section and the support portion is mounted on the outer legs.

11. The glazing unit according to claim 10 wherein the support portion has opposed recesses, the legs of the spacer frame have end portions extending over the base toward one another and the support portion is mounted on the outer legs with end portions of the outer legs in the recesses.

12. The glazing unit of claim 9 wherein bottom surface of the groove formed by the sheet engaging member and securing member is a surface portion of the support portion.

13. The glazing unit according to claim 8 wherein the spacer frame has a rectangular cross section and includes the base, vertical legs and an upper side and wherein the sheet engaging member is mounted on the upper side of the spacer frame.

14. The glazing unit according to claim 10 further including a shim mounted between the outer legs of the spacer frame and between the sheet engaging member and the base of the spacer frame.

15. The glazing unit according to claim 10 wherein the spacer frame is a closed spacer frame and has a rectangular shape, wherein at least one sheet retaining member is at each of two opposite elongated sides of the spacer frame.

16. The glazing unit according to claim 15 wherein each elongated side of the spacer frame has at least one sheet retaining member.

17. The glazing unit according to claim 16 wherein each elongated side of the spacer frame has at lest two sheet retaining members spaced from one another.

18. The glazing unit according to claim 15 further including a member to reduce thermal current paths around the third sheet.

19. The glazing unit according to claim 18 wherein the member to reduce thermal current paths includes the sheet retaining member extending along an elongated side of the spacer frame.

20. The glazing unit of claim 8 wherein the groove formed by the sheet engaging member and securing member has a sheet separator therein to provide two channels with the third sheet in one channel and further including a fourth sheet in the other channel.

21. The glazing unit according to claim 8 wherein the sheets are glass sheets, and the spacer frame is made of metal, outer surface of at least one of the sheets on outer surface of opposed legs has a photocatalytic cleaning film.

22. The multi-sheet glazing unit according to claim 8 wherein the sheets are glass sheets and at least one of the surfaces of the glass sheets has a coating to pass selective wavelengths of energy.

23. The multi-sheet glazing unit according to claim 8 wherein the sheets are glass sheets and at least one surface of one of the glass sheets has a water reducing film.

24. The multi-sheet glazing unit according to claim 9 wherein the support portion has a pair of opposed sides and a groove extending along at least a portion of each of the pair of opposed sides.

25. The glazing unit according to claim 9 wherein the support portion has a surface opposite to the surface of the non-vertical support and further including at least one protrusion extending from the surface of the support portion away from the surface of the non-vertical support.

26. The glazing unit according to claim 25 wherein the at least one securing member is pivotally mounted on the vertical support for movement toward and away from the vertical stop.

27. The glazing unit according to claim 8 wherein the securing member is pivotally mounted on the vertical support for movement toward and away from the vertical stop.

28. The glazing unit according to claim 8 wherein the non-vertical support has at least one hole or at least one protrusion and the securing member has at least one protrusion or at least one hole such that the at least one hole and the at least one protrusion cooperate with one another to secure the securing member on the non-vertical support.

29. A method of making a multi-sheet glazing unit comprising the steps of:

providing a spacer frame;

providing a plurality of sheet retaining members, at least one of the sheet retaining members has a sheet engaging member having a vertical portion and a non-vertical portion to provide an edge stop and a securing member;

mounting the sheet retaining members and the sheet engaging member of the at least one sheet retaining member on the spacer frame spaced from one another facing interior of the spacer frame;

biasing edge portions of a sheet against the sheet retaining members and against the edge stop of the at least one sheet retaining member;

positioning the securing member on the non-vertical portion of the at least one sheet retaining member to form a groove having peripheral and marginal edges of the sheet therein; and securing an outer sheet on each side of the spacer frame to provide the multi-sheet glazing unit.

30. The method as set forth in claim 29 wherein the multi-sheet glazing unit has two compartments between the three sheets and further including the step of providing a layer of a moisture-pervious adhesive having a desiccant therein communicating with each compartment.

31. The method as set forth in claim 30 wherein the spacer frame has a rectangular shape, said mounting stop includes the step of mounting at least one sheet retaining member on each side of the spacer frame.

32. The method as set forth in claim 31 further including the step of after the practice of the biasing step and prior to the practice of the positioning step, positioning a sheet separator on the non-vertical portion against the sheet, biasing another sheet against the sheet separator and thereafter practicing the positioning step.

* * * * *